US010844679B2

(12) United States Patent
Haugland

(10) Patent No.: US 10,844,679 B2
(45) Date of Patent: Nov. 24, 2020

(54) WIRELINE OPERATED DUMP BAILER AND METHOD FOR UNLOADING OF MATERIAL IN A WELL

(71) Applicant: Qinterra Technologies AS, Stavanger (NO)

(72) Inventor: Lasse Haugland, Bryne (NO)

(73) Assignee: Qinterra Technologies AS, Stavanger (NO)

( * ) Notice: Subject to any disclaimer, the term of this patent is extended or adjusted under 35 U.S.C. 154(b) by 423 days.

(21) Appl. No.: 15/513,482

(22) PCT Filed: Oct. 1, 2015

(86) PCT No.: PCT/NO2015/050181

§ 371 (c)(1),
(2) Date: Mar. 22, 2017

(87) PCT Pub. No.: WO2016/053113

PCT Pub. Date: Apr. 7, 2016

(65) Prior Publication Data

US 2017/0306714 A1 Oct. 26, 2017

(30) Foreign Application Priority Data

Oct. 3, 2014 (NO) ..... 20141189

(51) Int. Cl.

| | |
|---|---|
| ***E21B 27/02*** | (2006.01) |
| ***E21B 33/127*** | (2006.01) |
| ***E21B 34/06*** | (2006.01) |
| *E21B 37/00* | (2006.01) |
| *F04B 47/08* | (2006.01) |

(52) U.S. Cl.

CPC ..... *E21B 27/02* (2013.01); *E21B 33/1275* (2013.01); *E21B 34/06* (2013.01); *E21B 37/00* (2013.01); *F04B 47/08* (2013.01)

(58) Field of Classification Search

CPC ..... E21B 23/14; E21B 27/00; E21B 27/02; E21B 37/00

See application file for complete search history.

(56) References Cited

U.S. PATENT DOCUMENTS

| | | | |
|---|---|---|---|
| 5,469,918 | A | 11/1995 | Haberman |
| 5,582,251 | A | 12/1996 | Bailey et al. |
| 5,667,015 | A | 9/1997 | Harestad et al. |
| 5,881,807 | A | 3/1999 | Boe et al. |

(Continued)

FOREIGN PATENT DOCUMENTS

| | | | |
|---|---|---|---|
| EP | 2192262 | A1 | 6/2010 |
| NO | 315212 | B1 | 7/2003 |

(Continued)

*Primary Examiner* — Tara Schimpf

(74) *Attorney, Agent, or Firm* — Gable Gotwals

(57) ABSTRACT

This invention relates to a dump bailer (1) for insertion into a well (20) in the ground. The dump bailer (1) includes a receptacle (2) which communicates with surroundings through an inlet (4) and an outlet (6), and a pump (10) positioned in a flow path (7) between the inlet (4) and the outlet (6). The pump (10) is positioned at the outlet (6), and the pump (10) during transport of the dump bailer (1) in the well (20) constitutes a sealed barrier for the carried material (18) in the receptacle (2). A method for use of the dump bailer (1) is also described.

9 Claims, 5 Drawing Sheets

(56) References Cited

U.S. PATENT DOCUMENTS

| | | | | |
|---|---|---|---|---|
| 8,668,005 | B2 | 3/2014 | Colon et al. | |
| 2003/0066648 | A1 | 4/2003 | McMahan | |
| 2006/0102336 | A1* | 5/2006 | Campbell | E21B 27/02 166/65.1 |
| 2006/0144591 | A1* | 7/2006 | Gonzalez | E21B 29/10 166/277 |
| 2006/0213662 | A1 | 9/2006 | Creel et al. | |
| 2011/0214861 | A1 | 9/2011 | Rogers et al. | |
| 2014/0318782 | A1* | 10/2014 | Bourque | E21B 27/02 166/286 |
| 2015/0090453 | A1* | 4/2015 | Tolman | E21B 33/138 166/297 |
| 2015/0240583 | A1* | 8/2015 | Mineo | E21B 34/063 166/311 |

FOREIGN PATENT DOCUMENTS

| | | | |
|---|---|---|---|
| WO | 2013105865 | A1 | 7/2013 |
| WO | 2014051588 | A1 | 4/2014 |

* cited by examiner

WIRELINE OPERATED DUMP BAILER AND METHOD FOR UNLOADING OF MATERIAL IN A WELL

CROSS-REFERENCE TO RELATED APPLICATIONS

This United States application is the National Phase of PCT Application No. PCT/NO2015/050181 filed 1 Oct. 2015, which claims priority to Norwegian Patent Application No. 20141189 filed 3 Oct. 2014, each of which is incorporated herein by reference.

BACKGROUND OF THE INVENTION

The present invention relates to a device for unloading of material in a well. More specifically it relates to a dump bailer for insertion into a well in the ground wherein the dump bailer comprises a receptacle which communicates with the surroundings through an outlet and an inlet. The invention also comprises a method for use of the dump bailer.

For different reasons it may be necessary to bring in a quantity of typically liquid material at a certain location in a vertical well or a deviated well. It may for instance concern arranging of a material above an existing plug, adding a chemical for cleaning, or adding a curable material in order to form a plug.

On plugging it appears that known, so-called high-expansion plugs may often only withstand relatively small differential pressures. Plugs formed in a curable material may withstand relatively large differential pressures.

According to prior art a so-called dump bailer is often used in order to bring a certain amount of material into a well. Many dump bailers empty the fluid material out of the dump bailer by means of gravity. Such dump bailers are not suitable for use in deviated wells. In vertical wells the position of the dump bailer may be accurately determined by measuring the length of output cable. Thereby the unloading of material may be carried out at the desired location. In deviated wells it is known to use more complicated time controlled mechanisms for unloading of the material at the desired location.

Patent publication EP 2192262 thus describes a dump bailer wherein a piston is arranged in the chamber and wherein a carried volume of pressurized fluid, by means of valves, are led to one side of the piston in order to expel a carried material from the chamber.

Patent publication U.S. Pat. No. 8,668,005 concerns a dump bailer wherein an expandable cap or plug made of a magnetic material, is engaged in the outlet opening by means of a shear pin. An electric field is used for disengaging the cap or plug.

Patent publication U.S. Pat. No. 5,582,251 concerns a dump bailer which in a first end portion is fastened to a cable. A pump at the first end portion has an outlet into a flow path. A piston is positioned in the flow path below the pump. The flow path is provided with an outlet below the piston. A seal seals the flow path at the outlet. The material which is to be unloaded is kept in the flow path between the piston and the seal. The pump will push the piston downwards in the flow path such that the seal is broken and the material flows out through the outlet.

Patent publication WO 2014/051588 concerns a dump bailer which comprises a cylinder-shaped housing for transporting a material in a well. In a first end portion the dump bailer is provided with a rotary motor which drives a pump.

The dump bailer is in a second end portion provided with a fastened rupture disc at the lower open end of the housing. The pump comprises a threaded axle which extends through the housing in the longitudinal direction of the dump bailer. A piston is threadedly connected to the axle. The motor rotates the axle which drives the piston towards the second end portion. The rupture disc bursts open, and the material flows out from the open end of the housing. In an alternative embodiment the axle and the piston are replaced by a feed screw.

Patent publication US 2003/0066648 concerns a releasable barrier which is positioned in a well in order to prevent a cement slurry from migrating further down in the drilling fluid. The barrier is pumped in a folded position down through a working tube. The lower opening of the working tube may be positioned at an accurate depth in the well. When the barrier leaves the working tube through the lower opening, the barrier unfolds and creates a formwork at the desired location in the well. Cement is filled on the formwork on the upper side of the formwork. The patent publication U.S. Pat. No. 5,469,918 concerns a dump bailer provided with a releasable barrier in the form of a bridge plug at its lower free end portion. The bridge plug is set on the desired place in the well. At the same time a seal is activated and fastened to the free end of the dump bailer. The cement slurry flows out of the dump bailer while the dump bailer is slowly pulled up through the well. The seal prevents the drilling fluid on the outside of and above the dump bailer from mixing with the cement slurry.

It has been found that known valve control units in dump bailers may have an uncertain function and that unloading in deviated wells may be difficult to carry out with sufficient accuracy. A valve control unit in the form of a rupture disc may have the disadvantage that the rupture disc unintendedly bursts at an undesired time or undesired place. Such a bursting may be caused by a building up of pressure which exceeds the tolerance of the rupture disc. Ordinary rupture discs do not have any elasticity which can help the rupture disc in resisting the pressure. Such a pressure build-up may for instance happen by pressure testing of the dump bailer before it is introduced in the well.

In wells, such as petroleum producing wells, it is a problem that deposits in the well can reduce or hinder the functionality of installed equipment. Examples of such equipment may be safety valves and sliding sleeves. Deposits can also hinder the access to equipment or complicate operations such as pulling a valve from a side pocket mandrel or pulling a plug. Mechanical brushing is a known method for removing such deposits. Mechanical brushing will not always loosen or remove all deposits, especially not deposits in corners or in blind zones for a brush. It is known to use chemicals for dissolving deposits. Chemicals can also be used for lubricating movable parts. A chemical which flows over a surface which is going to be cleaned has a better effect than a chemical which is stagnant with regards to the surface. There may be a need for more chemicals in order to clean and/or lubricate a portion of the well than that which is the capacity of one dump bailer. It is then necessary that the dump bailer performs more trips in the well in order to be able to deliver a sufficient amount of chemicals.

It is known to remove hydrate plugs in a well by adding hydrate dissolving chemicals. A hydrate dissolving chemical increases its effect by flowing over the hydrate plug such that dissolved hydrate is transported away from the hydrate plug and fresh hydrate dissolving chemical is added. There may be a need for more hydrate dissolving chemical than that which is the capacity of one dump bailer. It is then necessary that the dump bailer performs more trips in the well in order to deliver a sufficient amount of chemicals.

The invention has for its object to remedy or to reduce at least one of the drawbacks of the prior art, or at least to provide a useful alternative to prior art.

The object is achieved through features, which are specified in the description below and in the claims that follow.

The invention concerns a dump bailer which is provided with a pump at the outlet of the dump bailer, and a method for operating a dump bailer provided with a pump.

The invention is defined by the independent patent claims. The dependent claims define advantageous embodiments of the invention.

The dump bailer according to the invention may be directly coupled to and controlled through a cable as known within the art. The dump bailer may alternatively be indirectly coupled to and controlled through a cable in that a wireline tractor is positioned between the dump bailer and the cable. A wireline tractor is known within the art.

The dump bailer according to the invention is filled with a material. The material may be constituted by a cement slurry, of one chemical or a mixture of chemicals. In the following the expression "chemical" does not exclude that it may also be a mixture of a plurality of chemicals.

The dump bailer according to the invention may be positioned in a sluice above a wellhead such as it is described in the applicant's own patent publication WO 2013/105865. The dump bailer may be filled with a chemical or a mixture of chemicals in a sluice as described in WO 2013/105865 without removing the dump bailer from the sluice. This has the advantage that time consuming pressure testing is avoided.

In a first aspect the invention more specifically concerns a dump bailer for insertion into a well in the ground wherein the dump bailer comprises a receptacle which communicates with the surroundings through an inlet and an outlet and a pump positioned in a flow path between the inlet and the outlet, and which is characterized in that the pump is positioned at the outlet, and that the pump during transport of the dump bailer in the well constitutes a tight barrier for a material carried in the receptacle.

When the dump bailer is arranged at the desired place in the well, the pump is started whereby a carried material which is in the dump bailer is delivered through the outlet independently of whether the dump bailer is situated in a vertical or a deviated well.

The outlet may most advantageously be positioned at the leading end portion of the dump bailer which is typically furthest inside of the well.

The receptacle may be provided with an axially displaceable piston in the flow path. The piston may be constituted by a so-called swabbing piston and may be provided with a seal between the piston and the inner wall of the receptacle. The piston has as its main task to separate different fluids. This is particularly important if the fluids have a tendency to mix. The piston may during transport in the wellbore constitute a barrier for the carried material. The piston may be left out when there is little danger that the material in the receptacle will mix with the surrounding liquid which may enter the receptacle through the inlet.

During transport in the wellbore, the pump constitutes a barrier for the carried material, which makes it a condition that the pump is sealingly closed when it is not in operation. A so-called mono pump which is also called a Moineau-pump after the inventor, or a PCP-pump (Progressive Cavity Pump), has shown to be appropriate for the purpose as such a pump is liquid tight when it is passive and it can pump a liquid which contains particular material when it is active. The mode of operation of the mono pump is known for a skilled person and will not be described further.

The dump bailer may be provided with a rotary motor for driving the pump. The rotary motor may be an electrically driven motor or a hydraulically driven motor. The pump may be driven by the rotary motor via an axle. The axle may extend through the receptacle. The piston may be displaceable along the axle. Other known operating solutions may also be possible, for example operation from adjacent equipment. In that respect the connection of the dump bailer to a wireline tractor is relevant, especially when it concerns wells with considerable deviation from the vertical axis.

The dump bailer may be provided with a first releasable barrier at the outlet. The barrier may for instance comprise an umbrella-like construction which at or before pumping out of carried material from the dump bailer, is arranged to be released from the outlet and seal against the wall of the well between the material which is pumped out and a surrounding liquid. The first barrier may be displaced further in the well by the material which is pumped out from the dump bailer.

The dump bailer may at the outlet be provided with a second releasable barrier which in the same way as the first barrier is arranged to be able to seal against the wall of the well between the material which is pumped out and the surrounding liquid. The second barrier may be provided with an opening which is releasably connected to and in communication with the outlet. The material may thereby be pumped through the opening in the second barrier. The pumped-out material is thereby filled into a space between the two barriers with the result that the mixing with the surrounding liquid is substantially avoided.

The opening in the second barrier may be provided with a valve in order to prevent backflow of material when the second barrier is disconnected from the outlet.

The dump bailer is suitable for unloading a material which may be constituted by a curable material such as cement. The dump bailer is also suitable for unloading a material which may be constituted by a detergent chemical and/or a lubricating chemical. The dump bailer is also suitable for unloading a material which is constituted by a hydrate dissolving chemical.

The invention also concerns a method for use of a dump bailer for insertion into a well in the ground wherein the dump bailer comprises a receptacle which communicates with the surroundings through an outlet and an inlet, and the method may comprise to provide the dump bailer with a pump in a flow path between the inlet and the outlet; and to pump a material which is in the receptacle out into the well.

In a second aspect the invention more specifically concerns a method for unloading a material in a well in the ground by means of a dump bailer as described above and characterized in that the method comprises:

- to unload the material in the receptacle through the outlet of the dump bailer;
- let the unloaded material flow along the outer side of the dump bailer; and
- let the unloaded material flow into the receptacle through the inlet.

It is also possible to let the unloaded material flow into the receptacle through the outlet and out of the receptacle through the inlet by letting the pump rotate in the opposite direction.

With the method it is achieved that the material flows over a portion of the inside of the well. If desired, parts of the unloaded material may be recollected in the receptacle. The collected material may be transported out of the well. The collected material may contain substances which are released from the well.

The method may further comprise to let the unloaded material circulate for a desired amount of time through the flow path, on the outer side of the dump bailer and back to the flow path. This has the advantage that the unloaded material may maintain a flowing movement over a portion of the inside of the well for as long as desired. It is also possible to let the unloaded material flow into the receptacle through the outlet and out of the receptacle through the inlet by letting the pump rotate in the opposite direction.

The unloaded material may comprise a detergent chemical. The unloaded material may comprise a lubricating chemical. The unloaded material may comprise a hydrate dissolving chemical.

There is also described a dump bailer for insertion into a well in the ground wherein the dump bailer may comprise a receptacle which communicates with the surroundings via an inlet and an outlet, and a pump positioned in a flow path between the inlet and the outlet, and the outlet may be provided with a release valve for keeping the material in the receptacle, and which is characterized by the release valve comprising a rupture disc in a first floating piston at the outlet. When the dump bailer is arranged at the desired location in the well, the pump is started whereby a carried material which is in the dump bailer, is delivered through the outlet, regardless of where the dump bailer is located in a vertical or deviated well.

The floating piston may be arranged to move inwardly in the receptacle. When the pump is passive, the pressure in the material in the receptacle will be the same as the surrounding pressure. The first floating piston may be provided with a seal between the piston and the inner wall of the receptacle.

The outlet may most advantageously be located at the leading end portion of the dump bailer, which typically is furthest inside the well.

The receptacle may be provided with an axially displaceable piston in the flow path. The piston may be constituted by a so-called swabbing piston and may be provided with a seal between the piston and the inner wall of the receptacle. The piston may be a second floating piston. The piston has for its main task to separate different fluids. This is particularly important if the fluids have a tendency towards mixing with each other. The piston may constitute a barrier for the carried material during transport in the wellbore. The piston may be left out when there is little danger for the material in the receptacle to mix with the surrounding liquid which may enter the receptacle through the inlet.

The pump may be a mono pump which has proved to be appropriate for the purpose as such a pump can also pump a liquid which contains particular material.

The dump bailer may be provided with a rotary motor for driving the pump. The rotary motor may be an electrically driven motor or a hydraulically driven motor. Other known operation solutions may also be relevant, for instance operation from adjacent equipment. In that respect a coupling of the dump bailer to a wireline tractor is relevant, especially when it concerns wells with considerable deviation from the vertical axis.

The dump bailer may at the outlet be provided with a first releasable barrier. The barrier may for instance comprise an umbrella-like construction which at or before pumping out of carried material from the dump bailer, is arranged to be released from the outlet and seal against the wall of the well between the material which is pumped out and a surrounding liquid. The first barrier may be displaced further into the well by the material which is pumped out from the dump bailer.

The dump bailer may at the outlet be provided with a second releasable barrier which in the same way as the first barrier is arranged to be able to seal against the wall of the well between the material which is pumped out and the surrounding liquid. The second barrier may be provided with an opening which is releasably connected to and in communication with the outlet. Material may thereby be pumped through the opening in the second barrier. The pumped-out material is thereby filled into a space between the two barriers with the result that the mixing with the surrounding liquid is substantially avoided.

The opening of the second barrier may be provided with a valve for preventing backflow of material when the second barrier is disconnected from the outlet.

Also described is a method for providing a dump bailer for insertion into a well in the ground, and a method for emptying the dump bailer at a desired location in the well. The dump bailer may comprise a rupture disc in a first floating piston at the outlet.

An apparatus and method according to the invention provide a relatively simple and reliable dump bailer which is based on known and well proven components. The dump bailer is as suitable for use in vertical wells as in deviated wells. By means of additional components it may, as described above, be ensured that liquids do not unintendedly mix.

The material which is transported in the dump bailer may be constituted by a chemical for cleaning and/or lubricating a piece of equipment such as a plug or a valve. The material may alternatively be constituted by a curable material to form a plug. The curable material may be constituted by a cement mixture also called cement slurry.

In the following are described examples of preferred embodiments illustrated in the accompanying drawings, wherein.

Figure 1A:
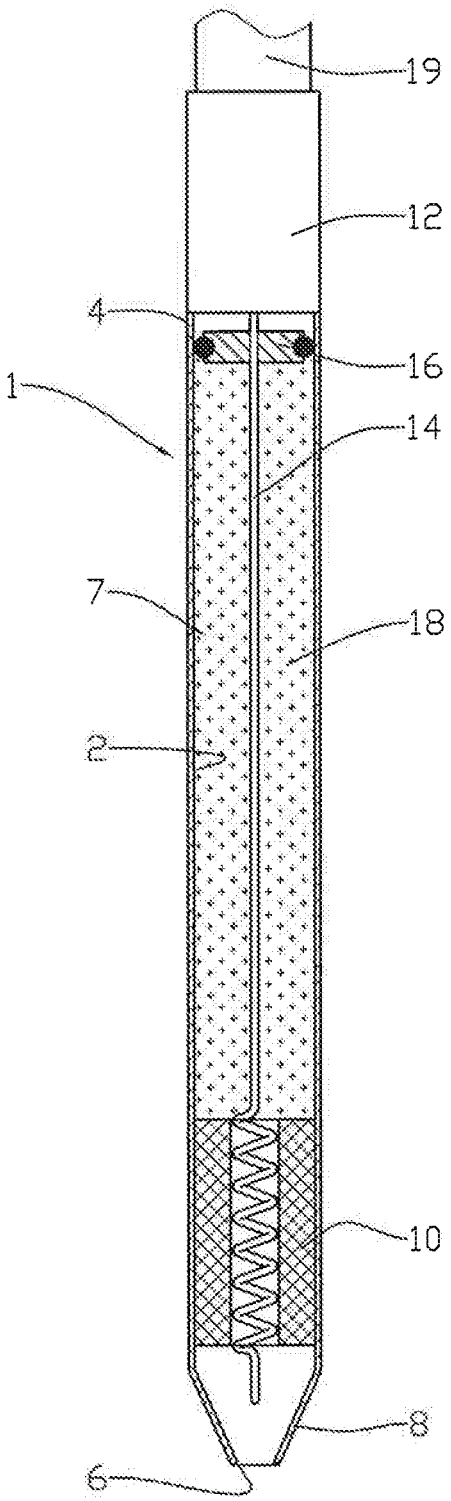
FIG. 1A shows a principle sketch of a dump bailer according to the invention.
Figure 1B:
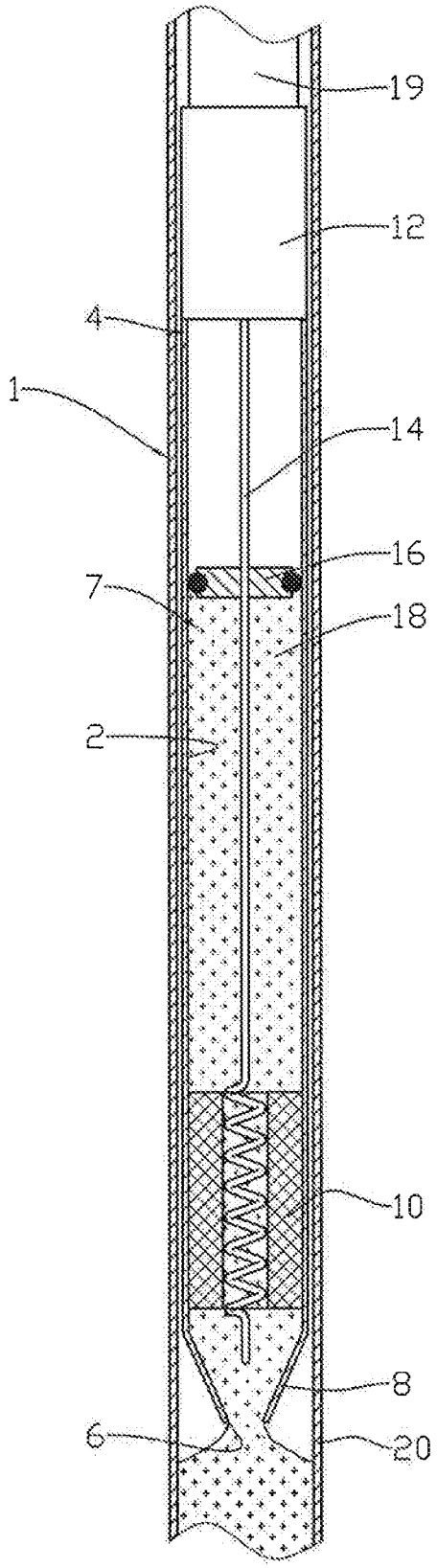
FIG. 1B shows the dump bailer of FIG. 1A arranged in a well and wherein carried material is being pumped out.

On the figures the reference numeral 1 denotes a dump bailer according to the invention. The dump bailer 1 preferably comprises a cylindrical receptacle 2 which typically also constitutes the load-bearing main element of the dump bailer 1. The receptacle 2 is provided with an inlet 4 and an outlet 6 which communicatively connects the receptacle 2 and the surroundings. The inlet 4, the receptacle 2 and the outlet 6 constitute a flow path 7 through the dump bailer 1.

The outlet 6 is most preferably located at the leading end portion 8 of the dump bailer 1, and may have any suitable shape.

A pump 10, here shown in the form of a mono pump, is arranged by the outlet 6 and driven by a rotary motor 12 via an axle 14. The inlet 4 is positioned between the rotary motor 12 and the pump 10.

Figure 5:
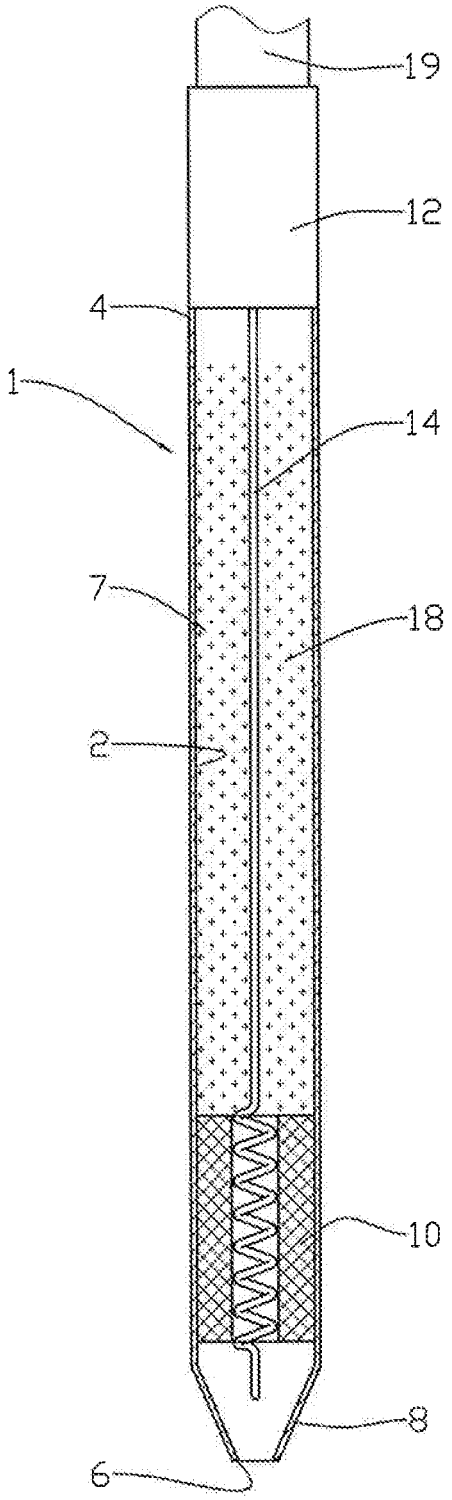
FIG. 5 shows the dump bailer of FIG. 1A in an embodiment without an upper piston.

A piston 16 is sealingly displaceable in the receptacle 2 and along the axle 14. The piston 16 may be left out when there is little risk that the material 18 in the receptacle 2 will mix with the surrounding liquid as shown in FIG. 5. The piston 16 is positioned in the flow path 7 between the inlet 4 and the outlet 6.

The dump bailer 1 is typically displaced in the well 20 by means of a not shown wireline, but may also be coupled to a wireline tractor 19.

When the dump bailer 1 is at the desired location in a well 20, the rotary motor 12 is started whereby the pump 10 starts and pumps material 18 out through the outlet 6. An under-pressure then forms in the receptacle 2 and surrounding liquid which flows in through the inlet 4 displaces the piston towards the pump 10 until the receptacle 2 is emptied and the material 18 has flowed into the well 20.

Figure 2A:
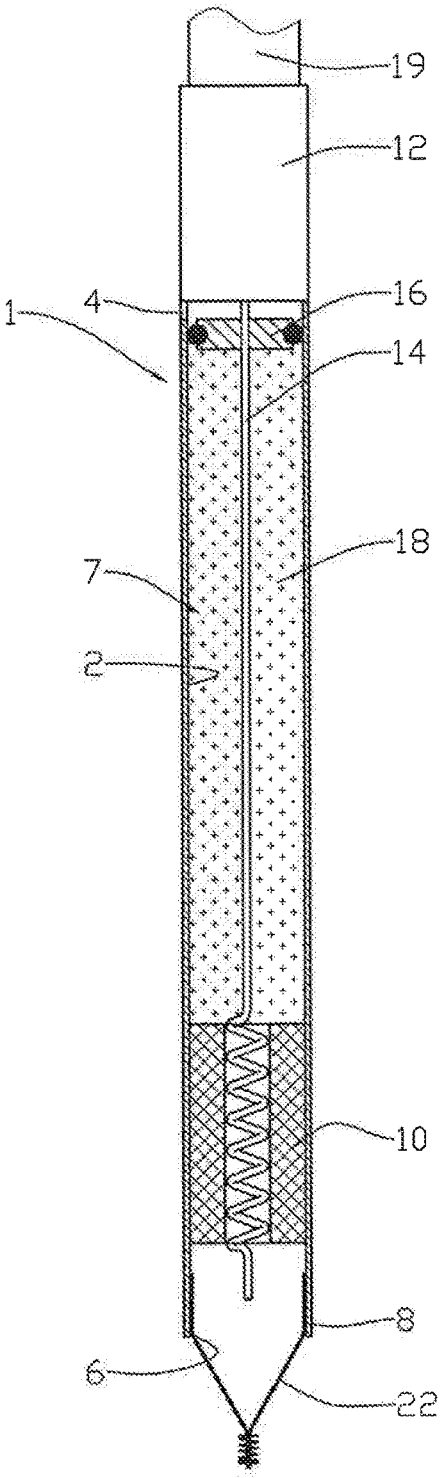
FIG. 2A shows the dump bailer of FIG. 1A in an embodiment wherein a first barrier is arranged at an outlet.

In FIG. 2A an embodiment is shown where the dump bailer 1 at the outlet 6 is provided with a first barrier 22. The first barrier 22 is arranged to form a barrier between the well 20 and the material 18 which is pumped from the dump bailer 1.

Figure 2B:
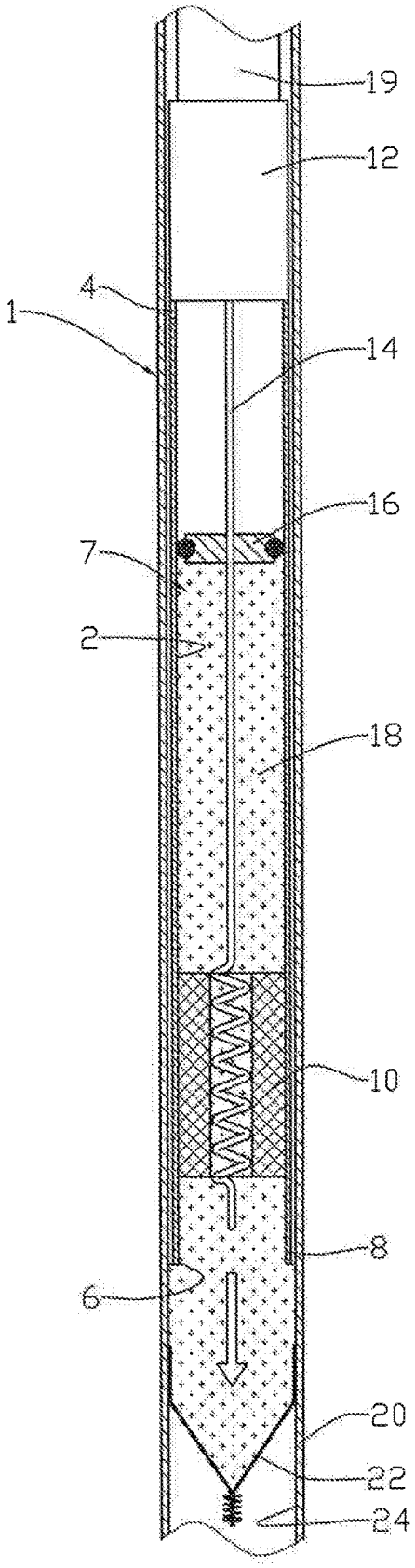
FIG. 2B shows the dump bailer of FIG. 2A arranged in a well wherein the first barrier is released from the dump bailer and wherein the carried material is being pumped out.

The first barrier 22 may generally be of the "umbrella-type" which is arranged to open towards a wall 24 of the well when it is displaced out from the outlet 6, see FIG. 2B.

Figure 3A:
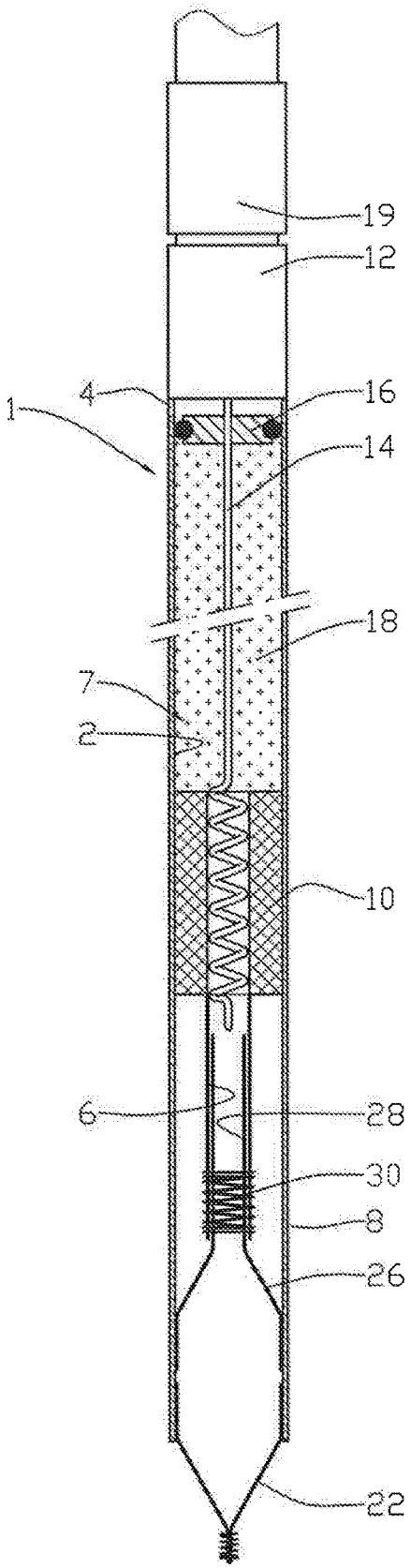
FIG. 3A shows the dump bailer of FIG. 2A in an embodiment wherein a second barrier is arranged at the outlet.
Figure 3B:
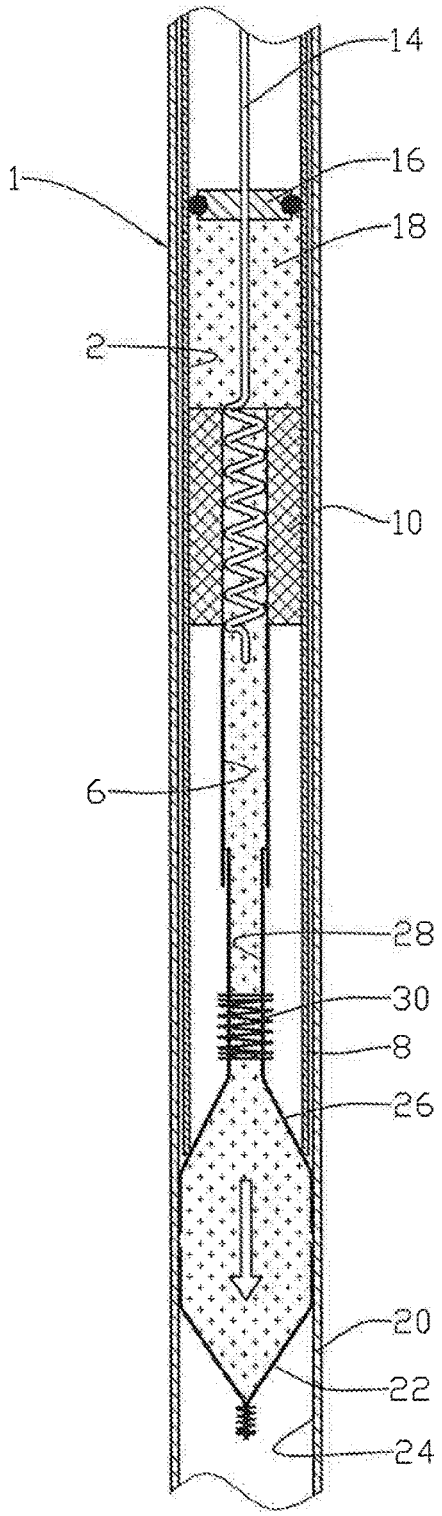
FIG. 3B shows the dump bailer of FIG. 3A arranged in a well and wherein the first barrier is released from the dump bailer and wherein the carried material is being pumped out through an opening in the second barrier.

FIG. 3A shows an embodiment wherein there is also arranged a second barrier 26 between the outlet 6 and the first barrier 22. In this embodiment the second barrier 26 is telescopically coupled to the outlet 6 via an opening 28. The material 18 may thereby flow through the opening 28 and in between the first barrier 22 and the second barrier 26 after that the second barrier 26 has been brought into a sealing position against the wall 24 of the well as shown in FIG. 3B. The first barrier 22 and the second barrier 26 are displaced axially and relative to each other during pumping in of the material 18 between them.

A valve 30, here in the form of a check valve, prevents the material 18 from flowing out through the opening 28 after that the dump bailer 1 is displaced away from the second barrier 26.

The piston 16 is left out when the material 18 in the receptacle 2 is going to be circulated out through the opening 6 and back to the receptacle 2 through the inlet 4. This embodiment is shown in FIG. 5.

Figure 4A:
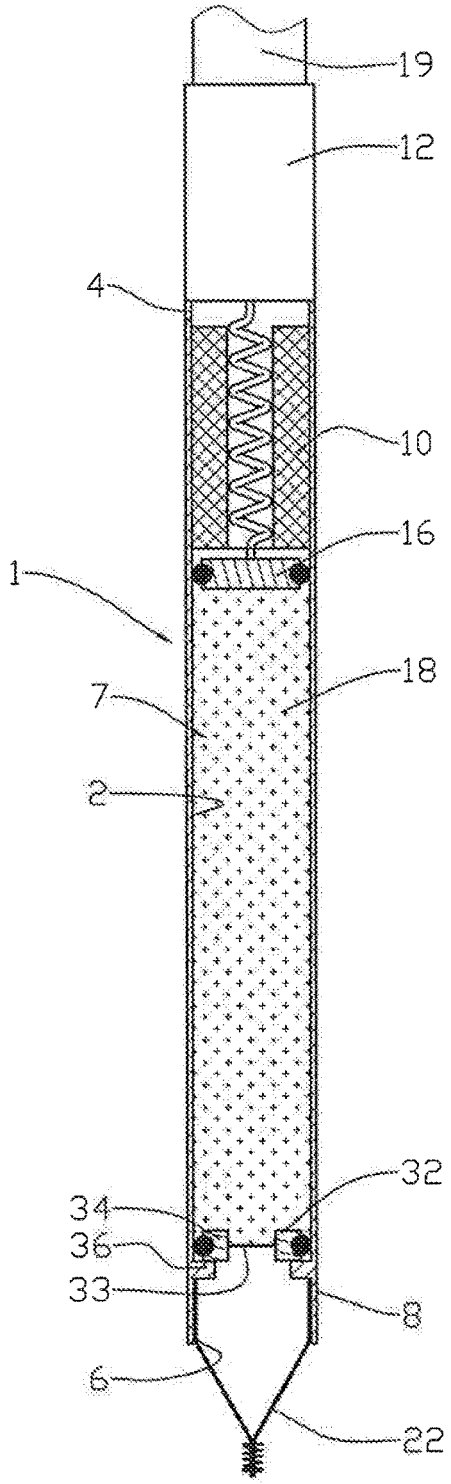
FIG. 4A shows the dump bailer in an alternative embodiment, and wherein a first barrier is arranged at the outlet.
Figure 4B:
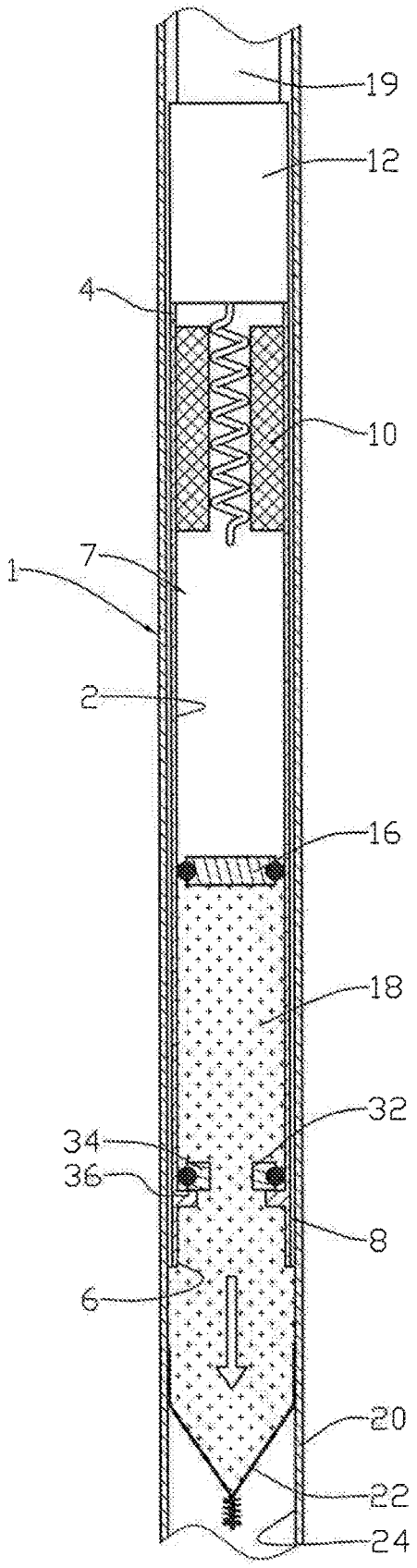
FIG. 4B shows the dump bailer of FIG. 4A arranged in a well and wherein the first barrier is released from the dump bailer and the carried material is being pumped out.

In an alternative embodiment which is shown in FIG. 4A, the pump 10 is arranged close to the rotary motor 12. A release valve 32, here shown in the form of a rupture disc 33 in a first floating piston 34, prevents the material 18 from flowing out of the outlet 6. The material 18 is close to the pump 10 limited by a second floating piston 16. The pressure in the material 18 is in balance with the surrounding pressure.

When the rotary motor 12 is started and drives the pump 10, surrounding liquid flows through the inlet 4 and the pump 10. The first floating piston 34 abuts against the shoulder 36 at the end portion 8. The pressure in the material 18 in the receptacle 2 increases until the release valve 32 opens, typically by breaking of the rupture disc 33. The material 18 thereafter flows through the outlet 6 and into the well 20.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The invention claimed is:

1. Dump bailer for insertion in a well in the ground, the dump bailer comprises:

a receptacle, provided with an axially displaceable swabbing piston arranged to separate different fluids in a flow path, communicates with surroundings through an inlet and an outlet; and a Moineau-pump comprising a helical rotor positioned inside a helical stator, said Moineau-pump is positioned in the flow path between the inlet and the outlet, the Moineau-pump is positioned at the outlet and during transport of the dump bailer in the well constitutes a tight barrier for a carried material in the receptacle.

2. The dump bailer according to claim 1, wherein the outlet is at a leading end portion of the dump bailer.

3. The dump bailer according to claim 1, wherein the dump bailer is provided with a rotary motor.

4. The dump bailer according to claim 3, wherein the Moineau-pump is driven by the rotary motor via an axle.

5. The dump bailers according to claim 1, wherein the dump bailer is coupled to a wireline tractor.

6. The dump bailer (1) according to claim 1, wherein a first releasable barrier (22) is provided at the outlet (6).

7. The dump bailer (1) according to claim 1, wherein a second releasable barrier (26) is provided the outlet (6).

8. The dump hailer (1) according to claim 7, wherein the second barrier (26) is provided with an opening (28) being releasably and communicatively connected to the outlet (6).

9. The dump bailer (1) according to claim 8, wherein the opening (28) is provided with a valve (30).

* * * * *